United States Patent [19]

Shaw

[11] Patent Number: 4,582,320

[45] Date of Patent: Apr. 15, 1986

[54] EXERCISE EQUIPMENT

[76] Inventor: James H. Shaw, 1005 Oak Ter., Jonesboro, Ark. 72401

[21] Appl. No.: 652,943

[22] Filed: Sep. 21, 1984

[51] Int. Cl.[4] ..... A63B 21/04

[52] U.S. Cl. ..... 272/136; 272/134; 272/142; 272/143

[58] Field of Search ..... 272/117, 136, 134, 138, 272/142, 143, 144, 93, 103, 135, 137, 139, 140, 141; 267/58, 74, 153, 155

[56] References Cited

U.S. PATENT DOCUMENTS

| | | | |
|---|---|---|---|
| 2,718,397 | 9/1955 | Verkuilen | 272/103 |
| 3,032,399 | 5/1962 | Pyka | 267/74 |
| 3,638,941 | 2/1972 | Kulkens | 272/130 |
| 3,851,810 | 12/1974 | Jespersen | 267/58 X |
| 4,072,309 | 2/1978 | Wilson | 272/144 |
| 4,231,568 | 11/1980 | Riley et al. | 272/136 |
| 4,299,134 | 11/1981 | Roy et al. | 267/155 X |
| 4,316,609 | 11/1982 | Silberman | 272/118 |
| 4,328,965 | 5/1982 | Hatfield | 272/137 |
| 4,358,109 | 11/1982 | Schrems | 272/144 |
| 4,407,495 | 10/1983 | Wilson | 272/117 |
| 4,492,375 | 1/1985 | Connelly | 272/136 X |

FOREIGN PATENT DOCUMENTS

| | | | |
|---|---|---|---|
| 1913560 | 9/1970 | Fed. Rep. of Germany | 272/103 |

*Primary Examiner*—Richard J. Apley
*Assistant Examiner*—Robert W. Bahr
*Attorney, Agent, or Firm*—Pollock, Vande Sande & Priddy

[57] ABSTRACT

Apparatus for adjusting the vertical position on a vertically extending support rail of a resilient force-resisting element. The apparatus comprises a channel member having a bar or rod for retaining the channel member against the support rail while it is moved up or down and a pin for securing the channel member in a fixed, indexed position on the support rail. A device is also supplied for applying tension to the resilient force-resisting member which has been attached to the apparatus. The tension producing device comprises a horizontal rod affixed to a vertically movable channel by a rotatable journalled shaft which permits the horizontal rod to move toward or away from the support rail.

17 Claims, 5 Drawing Figures

6
9
3
73
50
47
41
61
53
79
44
55
81
51
52
82
2
6
31
32
38
35
33
14
15
13
16

FIG 3
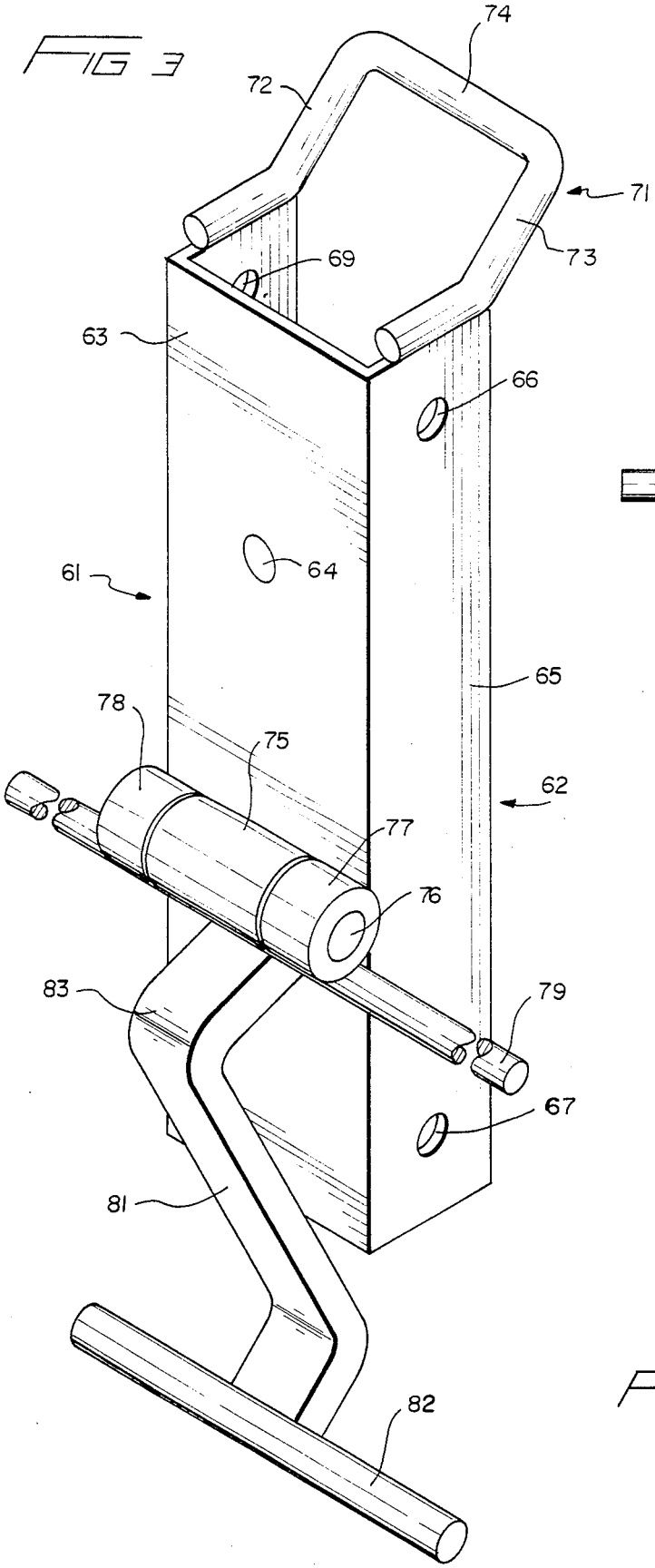
FIG 5
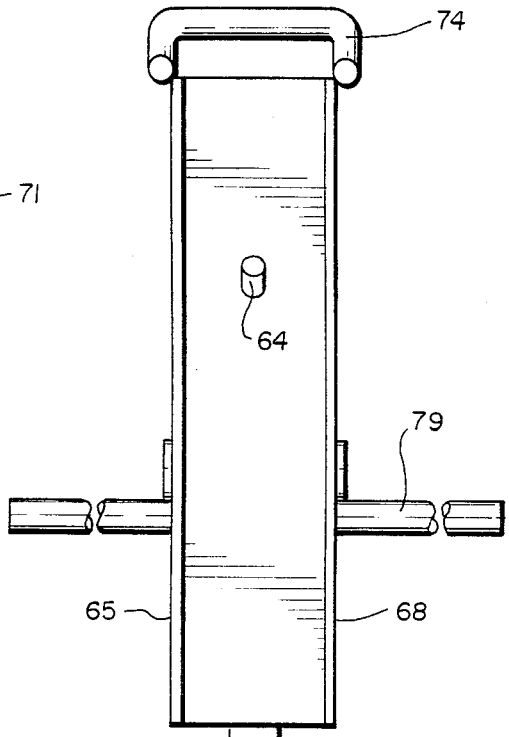
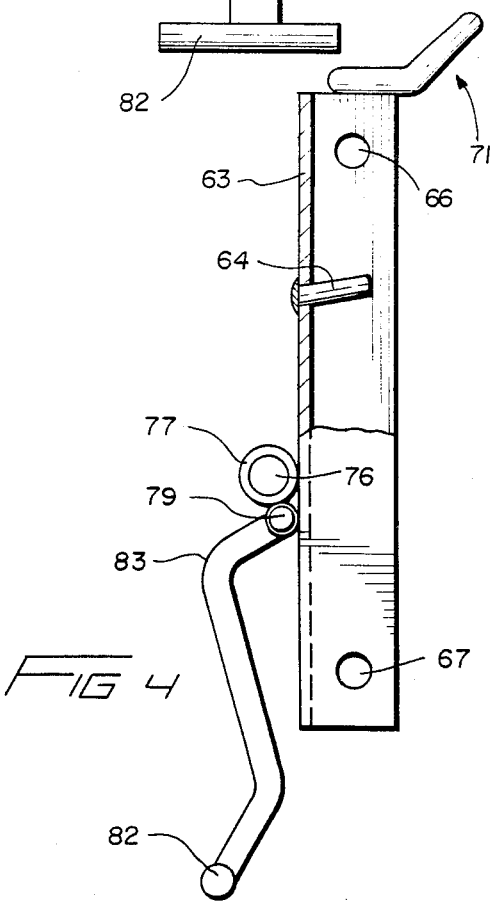
FIG 4

EXERCISE EQUIPMENT

BACKGROUND OF THE INVENTION

The present invention relates to exercise devices for developing and conditioning various muscles in the human body, and more particularly to exercise devices for aerobic conditioning in which exercise is obtained by exerting force against a resistant element.

There has been a growing awareness in recent years that physical exercise is important to mental and physical health and fitness. It is now generally believed that a conditioning program should entail exercise of a wide variety of muscles of the body and should also condition the heart and lungs, i.e., provide aerobic benefits.

An important part of some comprehensive exercise programs involves weight training which generally calls for specialized equipment. Barbells with removable weights comprise a simple and relatively inexpensive means for exercising some muscles. However, barbells are severely limited in the groups of muscles which can be strengthened or conditioned by their use. As a result of the limitations of the use of barbells alone in physical training, weight training devices have been developed which can provide many more exercises than can be obtained merely through the use of barbells. These devices generally provide resistance to an exerted force by means of weight and pulley arrangements, or by means of resilient elements such as springs or elastomeric elements such as elastic cords.

Apparatus which uses weights have certain disadvantages. First, it is necessary to have a large number of different weights available. Secondly, the addition or removal of weight is a potential source of accident. A further disadvantage lies in pulley and cable arrangements typically used which add to the weight and complexity of the apparatus and which is a potential cause of malfunctioning.

Resilient force-resisting elements, such as elastic cords, are light, easy to store, and provide a wide range of resisting forces. However, elastic elements are difficult to attach to exercise apparatus if it is necessary to stretch them to put them in place. As a result, in typical exercise apparatus, the elastic elements are placed in the apparatus under conditions where no tension is applied. However, this results in a dead spot where there is no resistance at the beginning of an exercise movement.

Many exercise devices, whether using weights or resilient force-resisting elements, are either large, expensive machines which are not practical for home use, or are specialized devices which either are capable of exercising only limited areas of the body or require difficult or time-consuming adjustments to afford a wide range of exercises for the user. It is generally believed that in order to achieve aerobic benefits in using exercise equipment, a series of exercises should be carried out within a relatively short time span, and no more than about 45 to 60 seconds should be allowed between exercises. This requires the capability of quickly and easily changing the apparatus from one set-up to another.

SUMMARY OF THE INVENTION

Accordingly, it is one object of the present invention to provide exercising apparatus which is capable of being used for a wide range of exercises.

Another object of the invention is to provide exercise equipment using resilient force-resisting means.

It is still another object to provide exercise equipment which is capable of being used to provide aerobic benefits.

It is yet another object to provide exercise equipment which can quickly and easily be changed from one type of exercise to another.

It is still another object to provide exercise equipment in which the magnitude of the resisting force can be quickly and easily changed.

It is also another object to provide exercise equipment which requires substantially equal force to move a force-applying member through all portions of an exercise stroke.

In accordance with the present invention, apparatus is provided for the vertical adjustment of a resisting force in an exercise assembly, wherein the exercise assembly includes a vertical support rail comprising a back wall and two parallel side walls, said apparatus comprising:

(a) an open-ended U-shaped channel member having a back wall and two parallel side walls, said channel member configured and dimensioned to fit snugly over the back and side walls of the support rail;

(b) retainer means disposed at the upper end of said channel member for securing said upper end against said support rail when said channel member is engaged with and parallel to said support rail, said retainer means being adapted to permit the lower end of the back wall of said channel member to move away from said support rail while the upper end of the back wall of said channel member remains in contact with said support rail;

(c) means affixed to said channel member for retaining said channel member at a fixed vertical position on said support rail when said channel member is in contact with and parallel to said back wall and said side walls of said support rail, and for releasing said channel member from said fixed vertical position when the lower open end of said channel member is moved away from said support rail; and (d) means secured to the outer surface of said channel member for engaging one end of a resilient force-resisting element.

This apparatus provides quick and easy adjustment of its vertical position on a support rail. In making an adjustment the means affixed to the channel to retain it in position on the support rail indexes the apparatus at locations where apertures in the side walls of the apparatus register with mating apertures in the side walls of the vertical supporting rail.

Further in accordance with this invention, there is provided tension adjusting means for engaging one end of a resilient force-resisting element comprising:

(a) a channel member vertically movable on a support rail, said channel member having a back wall and two parallel side walls;

(b) means for retaining said channel member at one or more fixed positions on said support rail;

(c) horizontal bar means adjustably secured near the outer surface of the back wall of said channel member;

(d) means for moving said horizontal bar means away from and toward the outer surface of said back wall of said channel member;

(e) means for retaining said horizontal bar in at least two different fixed positions with respect to said channel member; and (f) means for restricting movement of the horizontal bar from each of said fixed positions directly toward said channel member.

This aspect of the invention provides means for quickly and easily changing, removing or replacing the resilient forces, and provides means for remaining slack in the resilient forces prior to use.

BRIEF DESCRIPTION OF THE DRAWINGS

FIG. 3 is a perspective view of a combination of the vertical adjustment means and the adjustable resilient force attachment means.

FIG. 4 is a side view of the apparatus shown in FIG. 3.

FIG. 5 is a front view of the apparatus shown in FIG. 3.

DETAILED DESCRIPTION OF THE INVENTION

Figure 1:
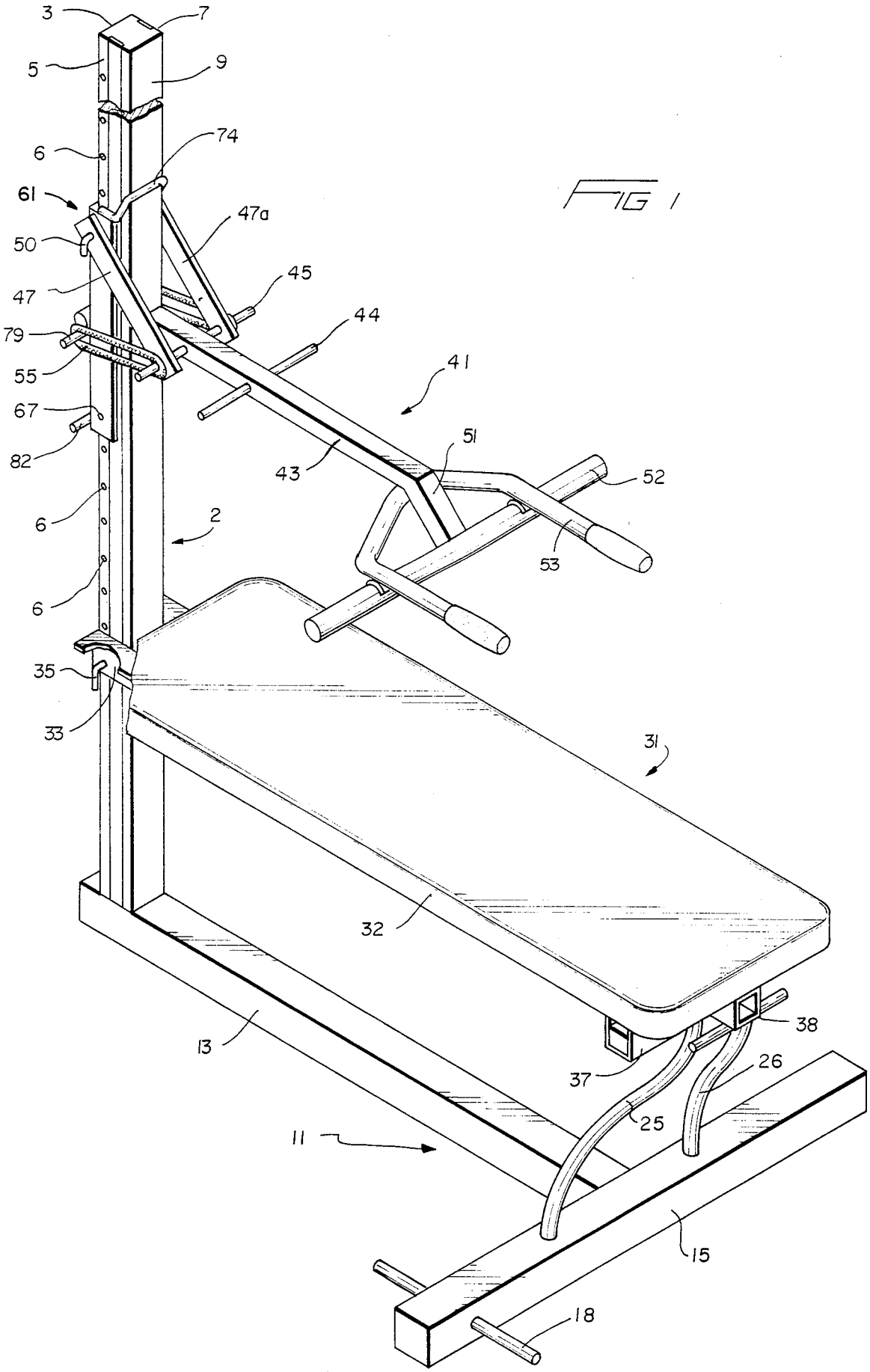
FIG. 1 is a perspective view of the present invention in place on one embodiment of exercise apparatus.

This invention may be used with different types of elastic force-resisting means, such as coiled springs, solid elastomeric elements and elastic cords. In the preferred form of the invention, the elastic force-resisting means comprises a plurality of loops of strands of rubber enclosed in a fabric. These are known as bunge cords, and the invention will be described in detail using bunge cords as the force-resisting means. Reference is now made to FIG. 3, which shows a device 61, referred to herein as a torque-pack which comprises two components, i.e., (1) means for vertically adjusting the torque-pack on a vertical support rail; and (2) tension adjusting means for adjustably securing one end of a resilient force-resisting means.

Vertical Adjusting Means

The vertical adjustment means of torque-pack 61 comprises channel member 62 having side walls 65, 68 and back wall 63. The channel member is provided with upper retaining means 71 comprising legs 72, 73 interconnected at their outer end with cross member 74. In the preferred form of the invention as shown in the Figures, upper retaining means 71 comprises a U-shaped member which is deformed by bending the pair of legs so that the outer portion of the legs may be welded to the top edges of walls 65 and 66 of channel member 62. The components of retaining means 71 are dimensioned so that when channel member 62 is in position against support rail 2, cross member 74 bears against front wall 9 of the support rail. In the apparatus shown in the Figures, retaining means 71 is provided with member 74 which extends between legs 72, 73. However, member 74 may be replaced by other structures such as, for example, short stub members extending perpendicularly from the outer ends of legs 72 and 73.

When channel member 62 is in position against and parallel to support rail 2, pin 64 extends into an aperture (not shown) in back wall 3 of support rail 2. Pin 64 holds the torque-pack 61 in a preselected position while resistance bar 41 (see FIGS. 1 and 2) is placed on the assembly. In order to make a vertical adjustment, the lower edge of channel member 62 is pulled away from support rail 2 far enough so that the pin 64 clears the aperture in back wall 3 in which it has been inserted. This movement swings cross member 74 in a downward direction, providing sufficient clearance between cross member 74 and the front wall 9 of support rail 2 for the torque-pack 61 to be moved either in an upward or a downward direction.

In the preferred embodiment of the invention, pin 64 is oriented upwardly at a slight angle, such as, for example, about 10° from the horizontal. Such an angle permits the pin 64 to fit snugly into the aperture in back wall 3 without binding as it is moved in or out of the aperture.

A pin which is oriented horizontally may be used, however, the resulting fit will not be snug inasmuch as one function of the pin 65 is to insure registration of side apertures 66, 69 and 67, with corresponding apertures in side walls 5 and 7 of support rail 2.

Channel member 62 with retaining means 71 and pin 64 may be used in combination with any means attached thereto which is capable of retaining one end of one or more bunge cords. For example, a horizontal bar may be affixed, as by welding, to back wall 63 of channel member 62.

Tension Adjusting Means

In another aspect of the invention, bunge cord(s) are affixed to a bar which is horizontally movable with respect to back wall 63. In the preferred form of this aspect of the invention as shown in FIGS. 3, 4 and 5, rod 79 is rotatably attached to journal box 75 through elements 77, 78 fixedly secured to shaft 76 which is rotatable in journal box 75. Bar 81 having handle 82 affixed to its outer end is fixedly secured as by welding to rod 79. When handle 82 is pulled upwardly from a down position as shown, rod 79 rotates around journal box 75 and is stopped at a point at which the outer surface of elbow 83 bears against back wall 63 of channel 62. The various elements of the structure are so dimensioned that the upward movement of rod 79 will stretch a bunge cord attached between rod 79 and the cooperating pin 45 of the exercise equipment.

The various elements are so dimensioned that bunge cord 55 may readily be placed between pin 45 (see FIGS. 1 and 2) and rod 79 when handle 82 is in the down position and there is a slight stress in bunge cord 55 when handle 82 is in the up position. This structure permits ready addition of the bunge cord to the apparatus and easy tightening of the bunge cord to eliminate dead spots during exercising. That is, the bunge cord can be tightened before exercise so that there is immediate resistance to movement.

The tension adjusting means may be used in combination with vertical adjusting means other than that described above, such as, for example, a simple U-shaped channel having holes in side walls, which register with holes in side walls of the vertical rail. However, in the preferred embodiment, the vertical adjusting means described herein is combined with this tension adjusting means.

Description of Overall Apparatus

Figure 2:
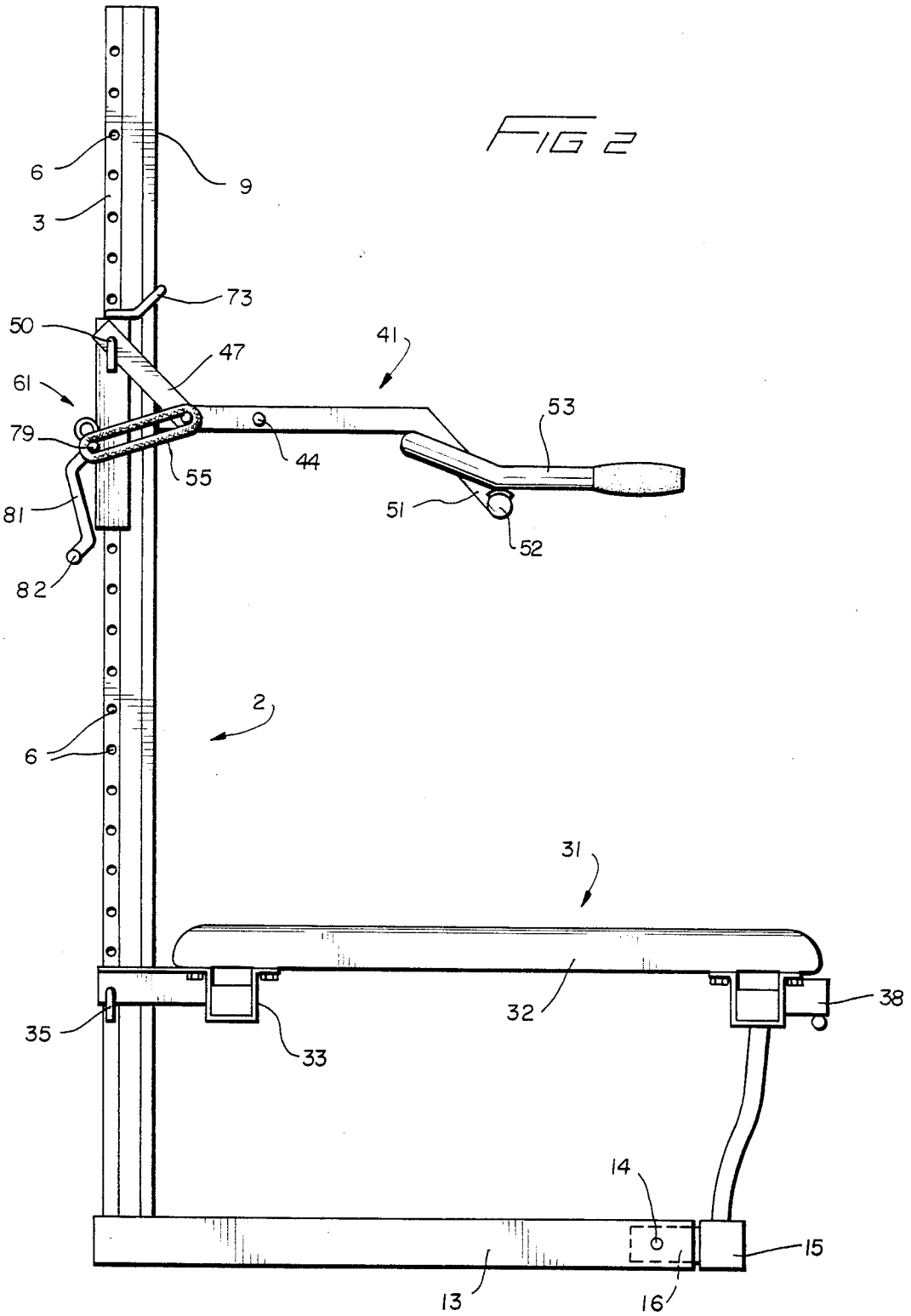
FIG. 2 is a side elevation view of the apparatus of FIG. 1.

The invention will now be illustrated by describing its combination with preferred embodiments of apparatus with which it may be used. FIGS. 1 and 2 show the torque-pack 61 in place on vertical support rail 2 having attached thereto T-shaped base 11 and bench assembly 31.

The torque-pack 61 is vertically adjustable on vertical support rail 2. Support rail 2 may be a channel having back wall 3 and side walls 5 and 7 but preferably is a square channel including front wall 9. Side wall 5 is provided with a series of vertically extending, spaced-apart apertures 6 which are in registration with a series of apertures (not shown) in side wall 7. The apertures preferably extend from a position near the top of vertical rail 2 to a position where the bench is secured, and are spaced about 2–3 inches apart. Back wall 3 is provided with a series of apertures (not shown) in a vertically extending line, and are positioned to provide proper registration for apertures 6 in the vertical rail with apertures 66,67,69 in walls walls 65,68 in channel 62.

Support rail 2 is securely attached as by welding to T-shaped base member 11 which comprises horizontal base rail 13, which is preferably formed from square tubing, and stabilizer 15 which is provided with stub 16 intermediate the ends thereof. Stub 16 is insertable into horizontal base rail 13 and secured in place by bolt 14. Stabilizer 15 is provided with holes in the upper surface (not shown) to accommodate legs 25, 26.

Bench assembly 31 comprises bench 32, head end attachment 33, and foot end attachment 37. The bench is supported in a preselected vertical position on the support rail 2 by pin 35 which is insertable into any one of the apertures in side walls 5 and 7. The foot end bench attachment 37 is provided with apertures (not shown) in the bottom for bench support legs 25 and 26 and in the device shown is provided with accessory mount 38. Accessory mount 38 may be used for attachments such as leg exercise equipment (not shown).

The apparatus as shown is readily adaptable for use with or without the bench in the position shown. The bench may be removed or its angle of inclination changed by removing pin 35 and lifting the bench assembly 31 away from the base 11, or changing the elevation of the head end.

Exercise may be performed using apparatus which is arranged as shown by pushing upwardly on outer bar handle 52 of resistance bar 41. Resistance bar 41 comprises central bar portion 43, downwardly angled outer bar portion 51, upwardly angled bar portions **47, 47*a* and pin 45. Inner bar portions 47, 47*a* are provided with apertures (not shown) which, when in registry with aperture 6 in side wall 5 and corresponding aperture in side wall 7 will be held in place by pin 50. The resistance is provided by bunge cords 55 which are looped over pin 45 and rod 79**.

The resistance bar is readily reversible by loosening and removing the bunge cord or cords, removing pin 50, pulling the resistance bar away from support rail 2, turning the resistance bar over, inserting pin 50 through aperture (not shown) in angle bar portion **47*a* into aperture 67, and replacing and tightening the bunge cords. This change will result in the resistance being exerted against downward movement of bar 52**.

Bunge cords are readily available to produce a variety of resisting forces and can be calibrated during their manufacture to produce a desired resistance. Bunge cords are, for example, available which, for each cord in place on the apparatus as shown, require a force of 10, 25, 50 or 100 pounds exerted in an upward direction on outer bar handle 52 to move the handle. The advantage of the bunge cord tightening arrangement in the torque-pack is apparent when it is considered that a movement of handle 52 in an upward direction of 22 inches will stretch bunge cord 55 only about six inches. Thus, a bunge cord which exerts a force of about 50 pounds at handle 52 exerts a considerable greater force, for example, 400 to 500 pounds, on pin 45 and rod 79. This is the force that would have to be applied to the bunge cord to place it over pin 45 and rod 79 in a stretched condition. The torque-pack 61 as shown provides a means for ready replacement of the bunge cords over pin 45 and rod 79 in a loose position to be followed by a step of moving rod 79 to a position farther away from pin 45 to thereby tighten the bunge cords. With the bunge cord in a tightened position, resistance is encountered at bar 52 immediately upon attempting to move it.

Bunge cords will usually be placed at both sides of the reistance bar, however, cords may be placed on just one side or the other, and the amount of force exerted by the bunge cords on the two sides need not be equal.

Several features shown in the drawings, while not cooperating with the torque-pack, are a part of the preferred overall apparatus. For example, pin 44 may be used in performing sit-ups by moving the inner end of the bench 32 upwardly so that it is inclined, sitting on the bench, and placing the toes beneath pin 44.

Similarly, pin 18 on stabilizer bar 15 may be used for an exercise known as roman chair sit-ups by sitting on a bench 32, placing the toes under pin 18 and then leaning backwards, followed by sitting up and repeating the sequence of movement.

Dip bar 53 is removably secured to resistance bar 41 and may be used by placing hands on the outer ends thereof with the torso above the dip bar 53 and elbows locked, and then alternately lowering and raising the body.

What is claimed is:

1. Exercise apparatus including a vertically extending support rail, said apparatus comprising:

(a) a channel member vertically movable on said support rail, said channel member having a back wall, and two parallel side walls;

(b) means for retaining said channel member at one or more fixed positions on said support rail;

(c) horizontal bar means adjustably secured near the outer surface of the back wall of said channel member;

(d) means for moving said horizontal bar means in a direction perpendicular to its axis away from and toward the outer surface of said back wall of said channel member;

(e) means for retaining said horizontal bar in at least two different fixed positions with respect to said channel member;

(f) means for restricting movement of the horizontal bar from each of said fixed positions directly toward said channel member;

(g) resistance bar means pivotally attached to said channel member; and, (h) biasing means for providing resistance to pivotal movement of said resistance bar means.

2. Apparatus according to claim 1 wherein said means for moving said horizontal bar away from and towards the outer surface of said back wall of said channel member comprises:

(a) journal box means horizontally mounted on the outer surface of the back wall of said channel member;

(b) rotatable shaft means mounted in said journal box means; and (c) means for fixedly securing said horizontal bar parallel to said shaft means whereby said horizontal bar is rotatable about said journal box means.

3. Apparatus according to claim 2 wherein said means for moving said horizontal bar away from and toward the outer surface of said back wall of said channel member includes handle means fixedly secured to the outer surface of and intermediate the ends of said horizontal bar.

4. Apparatus according to claim 3 wherein said handle means comprises a T-shaped member having a horizontal hand grasp and a vertical bar element having a bend therein, said bend comprising means for retaining said horizontal bar in a fixed position with respect to the channel member.

5. Apparatus according to claim 1 wherein said resilient force-resisting element comprises a bunge cord.

6. Exercise apparatus including a vertically-extending support rail comprising a back wall and two parallel side walls, said back wall having a plurality of spaced-apart apertures disposed in a straight line intermediate said side walls, said apparatus comprising:

(a) an open-ended U-shaped channel member having a back wall and two parallel side walls, said channel member configured and dimensioned to fit snugly over the back and side walls of said support rail;

(b) a pin member fixedly secured to the inner surface of said back wall of said channel member intermediate the ends thereof, said pin member being adapted to be insertable into said apertures in said back wall of said support rail;

(c) retainer means disposed at the upper open end of said channel member for securing said upper end against said support rail when said channel member is engaged with and parallel to said support rail, said retainer means being adapted to permit the lower end of the back wall of said channel member to be moved a sufficient distance from said support rail for said pin member to be withdrawn from apertures in said back wall of said support rail;

(d) horizontal bar means;

(e) means adjustably securing said horizontal bar means substantially parallel and adjacent the outer surface of the back wall of said channel member;

(f) means for moving said horizontal bar means in a direction perpendicular to its axis away from or towards the outer surface of said back wall of said channel member;

(g) means for retaining said horizontal bar means in at least two different fixed positions with respect to said channel member;

(h) means for restricting the movement of the horizontal bar from each of said fixed positions directly toward said channel member;

(i) resistance bar means pivotally attached to said channel member; and, (j) biasing means for providing resistance to pivotal movement of said resistance bar means.

7. Apparatus according to claim 6 wherein said vertically-extending support rail comprises a rectangular sleeve element.

8. Apparatus according to claim 6 wherein said retainer means comprises means affixed to said channel member at the front open end thereof.

9. Apparatus according to claim 6 wherein said retainer means comprises parallel legs extending upwardly and forwardly from the two parallel side walls and means extending inwardly from said parallel legs for engaging a front surface of said vertically-extending support rail.

10. Apparatus according to claim 6 wherein said retainer means comprises a substantially U-shaped bar having a horizontal portion joining two parallel leg portions, the outer end of each of said leg portions being fixedly secured to a side wall of said channel member at the upper end thereof and oriented to angle upwardly and forwardly so that said horizontal portion is at a higher elevation than the upper end of said back wall of said channel member.

11. Apparatus according to claim 5 wherein each of said legs is secured to a side wall along at least a portion of the length of said leg.

12. Apparatus according to claim 6 wherein said pin member is oriented to slant upwardly from its point of attachment to the back wall.

13. Apparatus according to claim 6 wherein said pin member is tapered.

14. Apparatus according to claim 6 wherein said means for moving said horizontal bar away from and towards the outer surface of said back wall of said channel member comprises:

(a) journal box means horizontally mounted on the outer surface of the back wall of said channel member;

(b) rotatable shaft means mounted in said journal box means; and (c) means for fixedly securing said horizontal parallel bar to said shaft means, whereby said horizontal bar is rotatable about said journal box means.

15. Apparatus according to claim 14 wherein said means for moving said horizontal bar away from and toward the outer surface of said back wall of said channel member includes handle means fixedly secured to the outer surface of and intermediate the ends of said horizontal bar.

16. Apparatus according to claim 15 wherein said handle means comprises a T-shaped member having a horizontal hand grasp and a vertical bar element, said bar element having a bend therein, said bend comprising means for retaining said horizontal bar in a fixed position with respect to the channel member.

17. Exercise apparatus including a vertically-extending support rail comprising a back wall and two parallel side walls, at least one of said side walls having a plurality of spaced-apart apertures disposed in a straight vertical line, said apparatus comprising:

(a) an open-ended U-shaped channel member having a back wall and two parallel side walls, said channel member being dimensioned to fit snugly over the back and side walls of said support rail;

(b) retaining means at the upper open end of said channel member for securing said upper end against said support rail when said channel member is engaged with and parallel to said support rail, said retainer means being adapted to permit the lower end of the back wall of said channel member to move away from said support rail while the upper end of the back wall of said channel member remains in contact with said support rail;

(c) means for retaining said channel member at a fixed vertical position on said support rail when said channel member is in contact with an parallel to said back wall and said side walls of said support rail, and for releasing said channel member from said fixed vertical position when the lower open end of said channel member is moved away from said support rail;

(d) journal box means horizontally mounted on the outer surface of the back wall of said channel member;

(e) rotatable shaft means mounted in said journal box means;

(f) horizontal bar means for engaging bunge cord means secured to said rotatable shaft means so as to move in a direction perpendicular to its axis away from or toward the back wall of said channel upon rotation of said shaft means;

(g) handle means secured to the outer surface of said horizontal bar means for rotating said horizontal bar and said rotatable shaft means about said journal box means, said handle means comprising a T-shaped member having a horizontal hand grasping means and a vertical bar element, said vertical bar element having a bend therein, said bend comprising means for retaining said horizontal bar in a fixed position with respect to said channel member;

(h) resistance bar means pivotally attached to said channel member; and, (i) biasing means for providing resistance to pivotal movement of said resistance bar means.

* * * * *